US006119846A

United States Patent [19]

Dufour et al.

[11] Patent Number: 6,119,846

[45] Date of Patent: Sep. 19, 2000

[54] COLLAPSIBLE GRIPPER MODULES

[75] Inventors: Charles Henry Dufour; Kevin Lauren Cote, both of Durham, N.H.

[73] Assignee: Heidelberger Druckmaschinen AG, Heidelberg, Germany

[21] Appl. No.: 09/072,802

[22] Filed: May 5, 1998

[51] Int. Cl.[7] ..... B65G 47/31

[52] U.S. Cl. ..... 198/462.2; 198/460.3

[58] Field of Search ..... 198/460.2, 460.3, 198/462.1, 462.2, 462.3, 795, 474.1, 803.4

[56] References Cited

U.S. PATENT DOCUMENTS

| | | | |
|---|---|---|---|
| 3,266,614 | 8/1966 | Griner | 198/460.3 |
| 4,007,824 | 2/1977 | Reist | 198/462.2 |
| 4,757,893 | 7/1988 | Shabram, Jr. et al. | 198/474.1 |
| 5,012,919 | 5/1991 | Trapp et al. | 198/474.1 |
| 5,394,974 | 3/1995 | Reist | 198/462.3 X |
| 5,967,741 | 10/1999 | Pessina et al. | 198/462.1 X |
| 5,975,280 | 11/1999 | Cote et al. | 198/474.1 |

*Primary Examiner*—James R. Bidwell
*Attorney, Agent, or Firm*—Kenyon & Kenyon

[57] ABSTRACT

A delivery device for sheets or signatures having a plurality of gripper modules including a first gripper module and a second gripper module and a track having a variable dimension to permit changes in pitch between the gripper modules. The first gripper module has a first leading end and a first trailing end and may have a first module step between the first leading end and the first trailing end, or a spring section.

19 Claims, 6 Drawing Sheets

COLLAPSIBLE GRIPPER MODULES

FIELD OF THE INVENTION

The present invention relates generally to a delivery systems for a signatures or sheets of paper, and more particularly to modules for a gripper conveyance system.

RELATED TECHNOLOGY

U.S. patent application Ser. No. 08/709,796 entitled "Device for Transporting Flat Products to Further Processing Units or Delivery Stations" was filed Sep. 9, 1996. This application shows a conveyance system comprised of individual gripper modules running on a track for delivering signatures or sheets of paper and is hereby incorporated by reference herein.

The use of modules as a conveyance system for delivering flat products, such as sheets of papers or signatures from a printed press permits fast delivery of flat products. However, it may be desirable to reduce the speed of the delivery system to permit processing or other actions to take place.

SUMMARY OF THE INVENTION

The present invention provides a delivery device having individual modules for carrying flat products and a track for the modules, the track having a variable track dimension so that the pitch between the flat products can be varied. The modules may have steps, or may be spring-loaded in the track. A switch-over device may be provided.

The present invention therefore permits the conveyance device to reduce the pitch between the grippers to enable slower speeds while permitting delivery of the same number of products per unit of time. Stated another way, the reduced pitch advantageously permits more signatures to be carried per unit length of track.

DETAILED DESCRIPTION

Figure 1A:
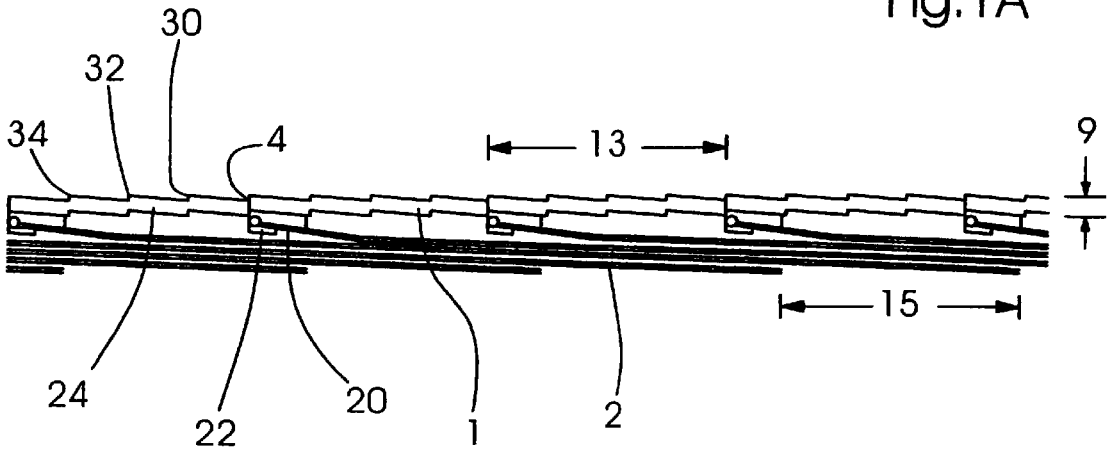
FIG. 1A shows a plurality of gripper modules of a first embodiment at a maximum pitch.
Figure 1A:
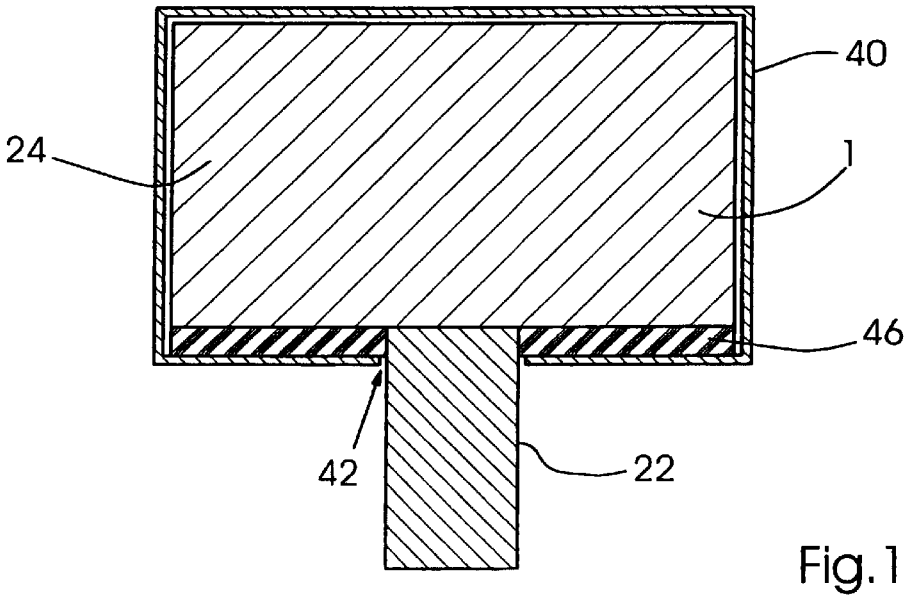

FIG. 1A shows a side view of a plurality of gripper modules 1 carrying shingled sheets 2, or other flat products. Each module 1 has a gripper 20, a gripper mount section 22 and a module base 24 and travels in a track (see FIG. 1B). The gripper modules 1 are pushed along at a pitch 13 with the leading end of an individual module pushing the trailing end of the module directly in front. The signatures have a pitch 15. Each module 1 has a first step 30, second step 32 and third step 34 located between the leading and trailing ends. A module-to-module interface is shown at number 4. The modules are constrained to travel in this direction by a track height 9.

Figure 1B:
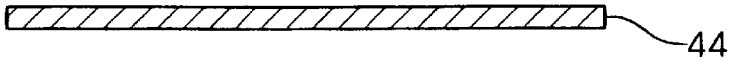
FIG. 1B shows a front view of a gripper module in a track.

As shown in FIG. 1B, the track 40 may have, for example, a rectangular cross-section with an open slot 42 at the bottom for the grippers 20 and mount section 22 to pass through. The signatures (not shown) may rest on a flat slide 44 below the track 40, although they also may hang free. The hatched area 46 represents the sloping front part of the module base 24 of the gripper module 1. The bottom of the hatched part is thus also the bottom of the step 34 resting on the track bottom.

Figure 3:
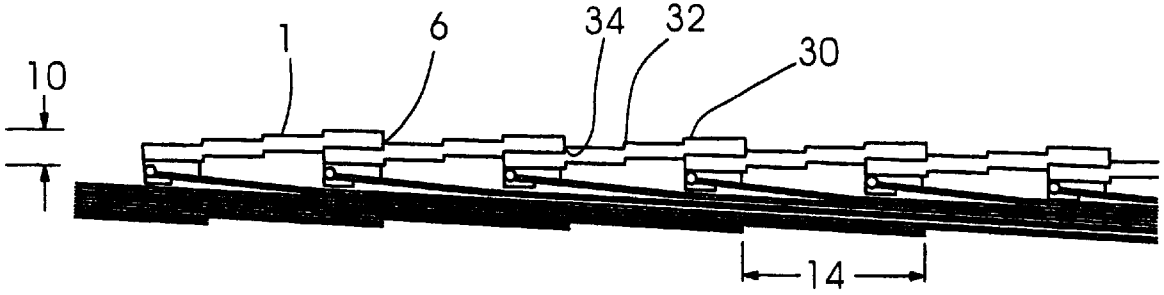
FIG. 3 shows the gripper modules of the first embodiment at a reduced pitch.

As shown in FIG. 3, the modules 1 can also travel at a reduced pitch to reduce the signature pitch 14. In this case a track height 10 has increased to allow the module-to-module interface to occur at number 6, as shown. The third step 34 of the modules 1 interacts with the trailing end of the module in front. The front end of the modules 1 can also interact with the first step 30 of the module in front, as shown.

The switch-over to the reduced pitch setting is best seen with reference to FIGS. 2A–D.

Figure 2A:
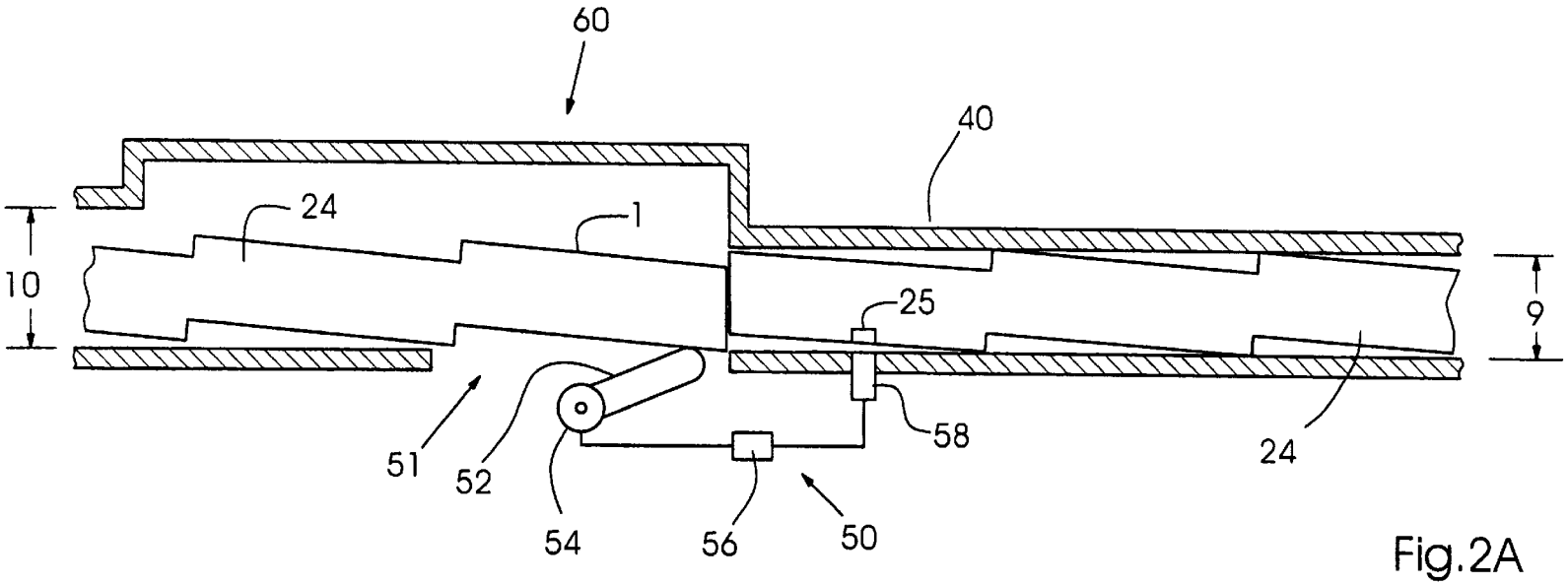
FIGS. 2A, 2B, and 2C shows the gripper modules of the first embodiment in a first switch-over area for reducing the pitch.

FIG. 2A shows a switch-over area 60 of the track 40 between heights 10 and 9. A switch-over device 50 for switching-over the modules 1 to a reduced pitch is also shown. The switch-over device 50 is located just below the beginning of the increased height section and may operate through a hole 51 in the bottom of the track 40, although this hole does not extend the whole width of the track (see FIG. 2D). The switch-over device 50 has a cam arm 52 on a rotating base 54, an electronic controller or microprocessor 56, and a magnetic sensor 58, for sensing a magnet 25 at the front end of the module base 24.

Figure 2B:
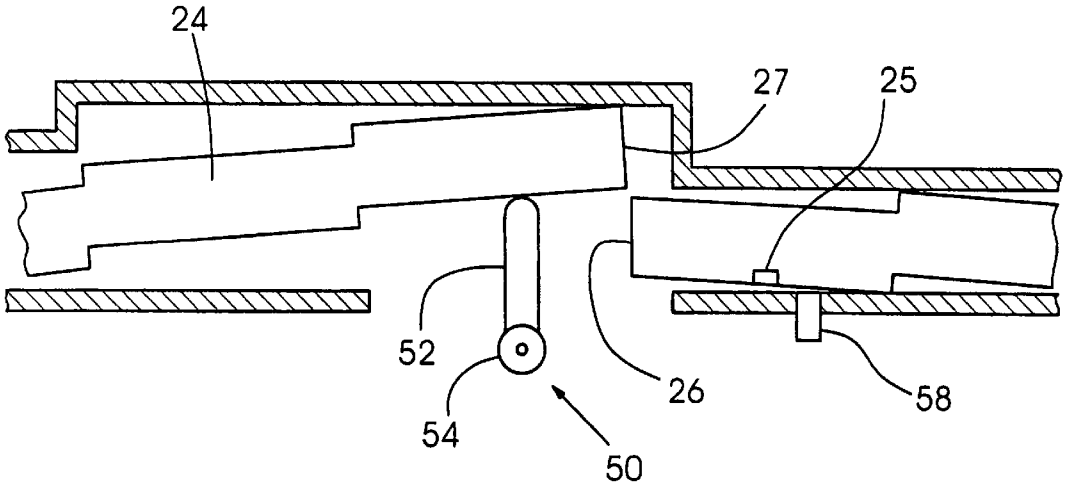

As shown in FIG. 2B, as the magnet 25 of the rear module passes by the sensor 58, the controller 56 causes base 54 to rotate cam arm 52 so as to raise the rear of the forward module base 24 so that a front end 26 of the next module no longer contacts the rear end 27 of the module base.

Figure 2C:
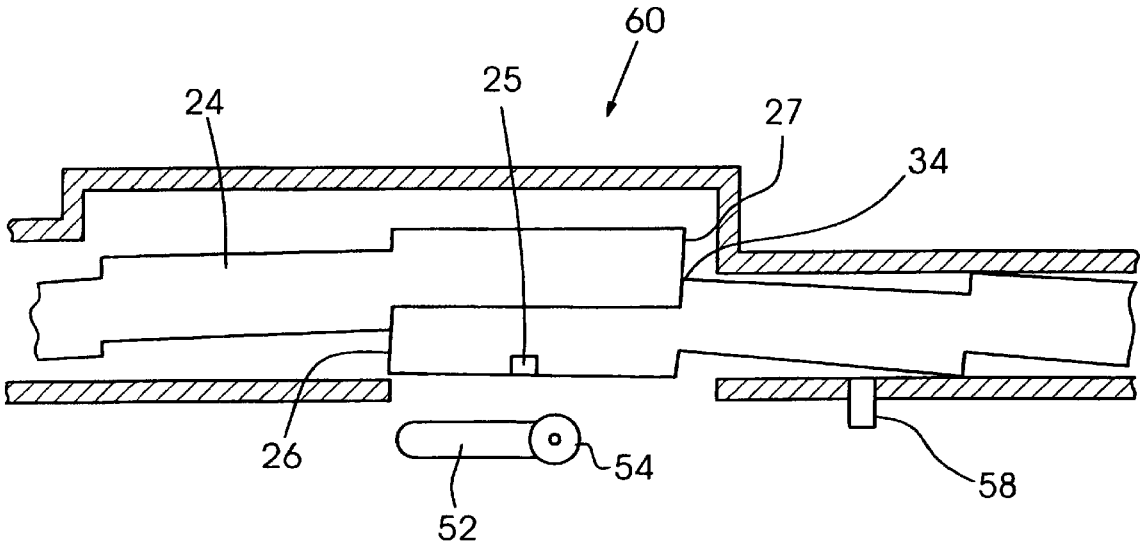

As shown in FIG. 2C, the front end 26 of the rear module then moves underneath the rear end 27 of the module base of the forward module, so that the first step 34 of the rear module interacts with the rear end 27 of the forward module, thus creating a reduced pitch. The cam arm 52 has moved further so that it is retracted.

Figure 2D:
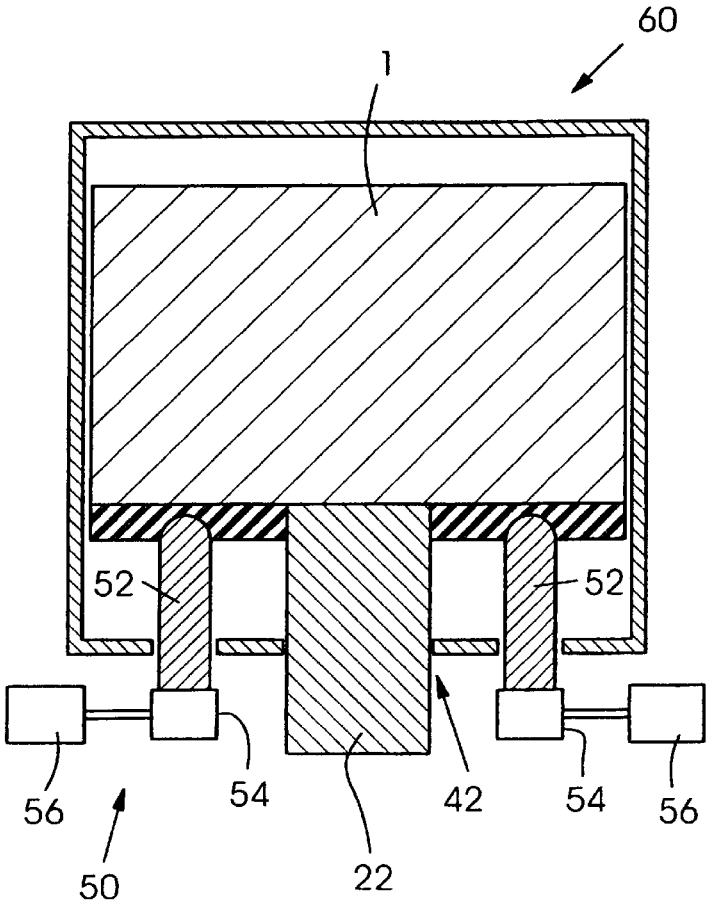
FIG. 2D shows a front view a gripper module in the switch over area.

FIG. 2D shows a front view of a module 1 in the switch-over area 60. The mount section 22 passes through open slot 42. The switch-over device 50 preferably comprises two cam mechanisms having cam arms 52, rotating bases 54 and controllers 56 as shown. The two cam mechanisms can be linked electronically or mechanically.

Figure 5:
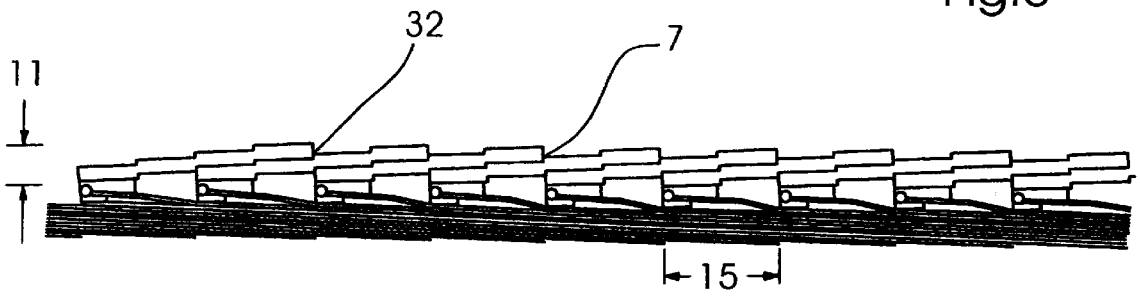
FIG. 5 shows the gripper modules of the first embodiment at a further reduced pitch.

As shown in FIG. 5, the modules can also travel at a further reduced pitch to provide the signatures a pitch 15 even further reduced from that shown in FIG. 3. In this case a track height 11 has increased further to allow the module-to-module interface to occur at number 7, so that the second step 32 of the modules 1 interacts with the trailing end of the module in front.

Figure 4:
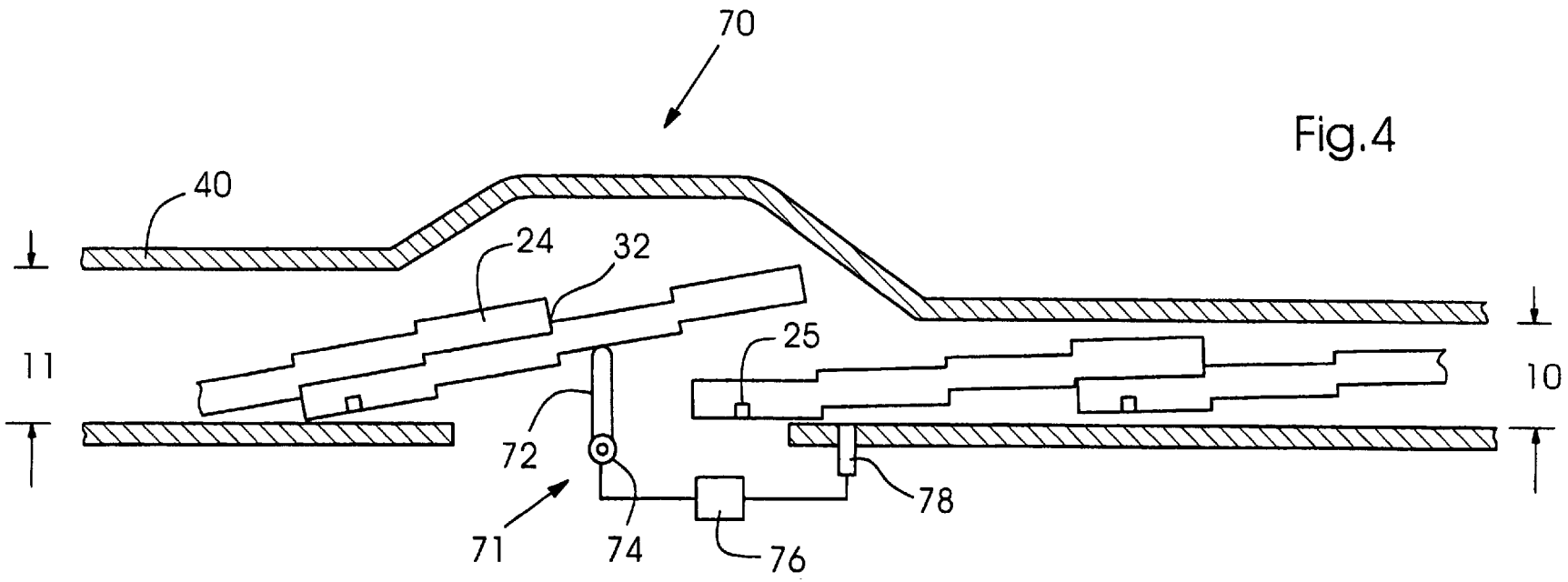
FIG. 4 shows a second switch-over area.

FIG. 4 shows a second switch-over area 70 of track 40 to switch the modules 1 from height 10 to height 11. The switch-over mechanism 71 has a cam arm 72, rotating base 74, controller 76 and sensor 78.

Figure 6:
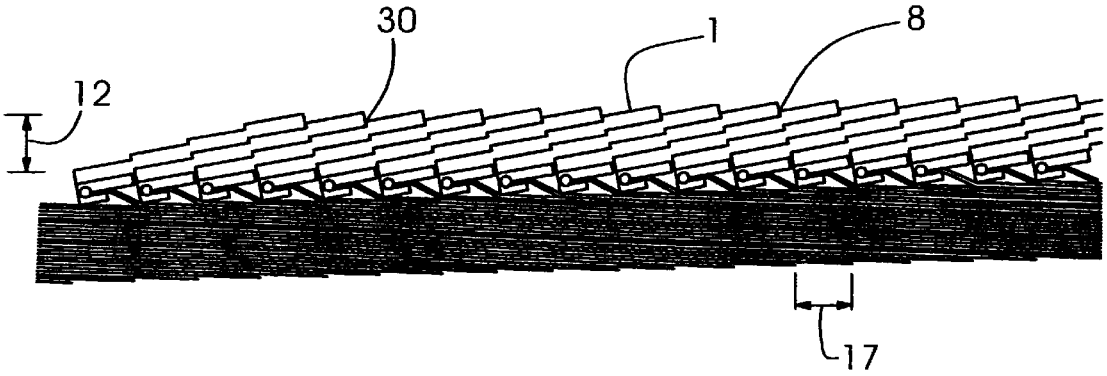
FIG. 6 shows the gripper modules at a minimum pitch.

In FIG. 6, the modules are shown traveling at a minimum pitch to create a signature pitch 17. The third step 30 of the modules 1 interacts with the trailing end of the module in front. The track height 12 has been increased to allow this module-to-module interface to occur at number 8. A switch-over area and device (not shown) can be provided to act on the modules between steps 34 and 32 to provide the switch over from track height 11 to track height 12.

It should be understood that other types of switch over devices may be provided with the above-embodiment, including a piston-type device.

Figure 7:
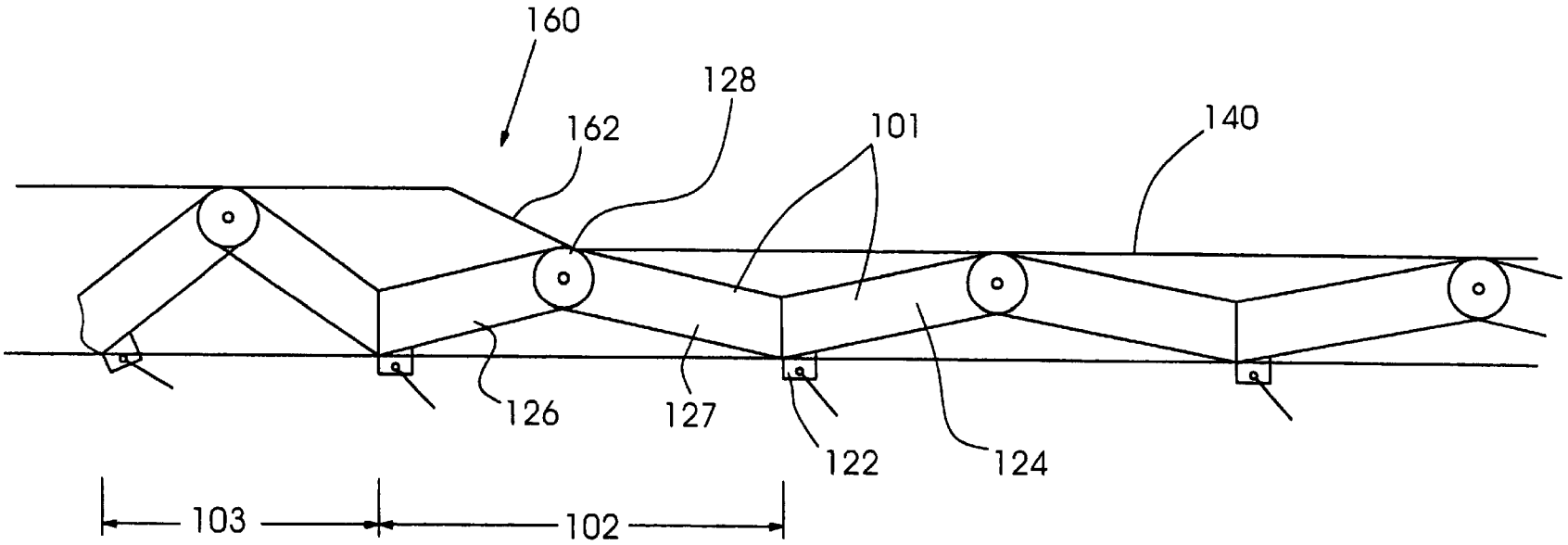
FIG. 7 shows a plurality of gripper modules of a second embodiment in a track.

FIG. 7 shows a second embodiment of the present invention in which gripper modules 101 travel in a track 140. Each module has a module body 124 and a gripper mount section 122 which can pass through a slot in bottom of the track 140. Each module body 124 comprises a first section 126 and a second section 127 connected by a torsion spring section 128. The spring section 128 acts to force the two sections 126 and 127 together as shown. A switch-over section 160 of the track 140 comprises a sloping section 162. As the modules pass through the switch-over section the spring section acts to force the sections 126 and 127 together and the height of the module body 124 increases while its length decreases. The decreased length thus permits a reduction in the pitch of the modules from pitch 102 to pitch 103.

What is claimed is:

1. A gripper module comprising:

a module base, the module base having a first section, a second section and a spring section, the spring section connecting the first section and the second section so as to force the first section and the second section together; and a gripper disposed in a fixed relation to the first section, wherein the gripper module is adapted to be carried by a track with a variable height, and length of the gripper module is dependent upon the height of the track.

2. A delivery device comprising:

a plurality of gripper modules including a first gripper module and a second gripper module, the first gripper module having a first leading end and a first trailing end, the second gripper module having a second leading end and a second trailing end, the first leading end interacting with the second trailing end; and a track for guiding the plurality of gripper modules, the track having a variable height for permitting variation of a pitch between the plurality of gripper modules.

3. The delivery device as recited in claim 2 wherein the first leading end directly contacts the second trailing end.

4. The delivery device as recited in claim 2 wherein the first gripper module has at least one step between the first leading end and the first trailing end.

5. The delivery device as recited in claim 2 wherein the first gripper module has at least two steps between the first leading end and the first trailing end.

6. The delivery device as recited in claim 2 wherein the first gripper module has a spring section.

7. The delivery device as recited in claim 2 wherein the first gripper module has two sections and a spring section, the spring section connecting the two sections so as to force the two sections together.

8. The delivery device as recited in claim 2 wherein the track has a switch-over section where the pitch is varied.

9. The delivery device as recited in claim 8 further comprising a switch-over device located at the switch-over section, the switch-over device interacting with the plurality of gripper modules individually.

10. The delivery device as recited in claim 9 wherein the switch-over device includes a cam arm.

11. A gripper module comprising:

the module base having a first end, a second end, a top surface, and a bottom surface, the bottom surface having a plurality of stepped sections between the first end and the second end for interfacing with another module base at a reduced pitch; and a gripper desposed in a fixed relation on the module base.

12. The gripper module as recited in claim 11 further comprising a gripper mount section connected to the module base, the gripper being mounted on the gripper mount section.

13. A delivery device comprising:

a plurality of gripper modules including a first gripper module and a second gripper module, the first gripper module having a first leading end and a first trailing end, the second gripper module having a second leading end and a second trailing end, the first leading end interacting with the second trailing end, the gripper module having at least one step between the first leading end and the first trailing end; and a track for guiding the plurality of gripper modules, the track having a variable dimension for permitting variation of a pitch between the plurality of gripper modules.

14. The delivery device as recited in claim 13 wherein the first leading end directly contacts the second trailing end.

15. The delivery device as recited in claim 13 wherein the variable dimension is a track height.

16. The delivery device as recited in claim 13 wherein the first gripper module has at least two steps between the first leading end and the first trailing end.

17. The delivery device as recited in claim 13 wherein the track has a switch-over section where the pitch is varied.

18. The delivery device as recited in claim 17 further comprising a switch-over device located at the switch-over section, the switch-over device interacting with the plurality of gripper modules individually.

19. The delivery device as recited in claim 18 wherein the switch-over device includes a cam arm.

* * * * *